United States Patent [19]

Begley

[11] Patent Number: 4,805,791

[45] Date of Patent: Feb. 21, 1989

[54] BAND WITH LOCK RING FOR TAMPER-EVIDENT CAP

[75] Inventor: Douglas G. Begley, Palatine, Ill.

[73] Assignee: Continental White Cap, Inc., Northbrook, Ill.

[21] Appl. No.: 190,086

[22] Filed: May 4, 1988

[51] Int. Cl.[4] ..... B65D 41/34

[52] U.S. Cl. ..... 215/252; 220/319; 292/256.6; 292/299

[58] Field of Search ..... 215/252, 274; 220/319; 292/299, 256.6

[56] References Cited

U.S. PATENT DOCUMENTS

| | | | |
|---|---|---|---|
| 1,062,532 | 5/1913 | Blair | 220/319 X |
| 1,969,524 | 8/1934 | Rollason | 292/256.6 |
| 1,982,806 | 12/1934 | Hayes | 220/319 X |
| 2,162,711 | 6/1939 | Hamberger . | |
| 2,162,752 | 6/1939 | Schauer . | |
| 2,172,159 | 9/1939 | Conner et al. . | |
| 2,491,139 | 12/1949 | Simonsen | 220/319 |
| 3,310,191 | 3/1967 | Kern et al. . | |
| 3,493,140 | 11/1968 | MacNeill . | |
| 4,344,383 | 8/1982 | Salt | 292/299 X |
| 4,493,427 | 1/1985 | Wolkonsky | 215/252 X |
| 4,503,986 | 3/1985 | Nixdorff et al. | 215/252 |
| 4,562,931 | 1/1986 | Brach et al. | 215/220 |
| 4,572,389 | 2/1986 | Gach | 215/253 |
| 4,610,367 | 9/1986 | Massott et al. | 215/252 |
| 4,756,438 | 7/1988 | Ryder | 215/252 |

*Primary Examiner*—Donald F. Norton

*Attorney, Agent, or Firm*—Charles E. Brown; Paul Shapiro; Charles A. Brown

[57] ABSTRACT

This relates to a tamper-evident closure cap having a tamper-evident structure for locking engagement beneath a transfer bead of a container neck finish. The closure cap includes a customary tamper-evident band which is of a diameter to freely pass over both external threads and a transfer bead of a container neck finish. In order that a bridge rupturing pressure may be applied to the tamper-evident band, there is provided a separate lock ring of a size to engage beneath the transfer bead while having an outer portion overlying the tamper-evident band to transfer pressure thereto during the removal of the closure cap. The lock ring is radially expansible to freely pass down over the threads and transfer beads during the application of the closure cap.

14 Claims, 1 Drawing Sheet

BAND WITH LOCK RING FOR TAMPER-EVIDENT CAP

This invention relates in general to new and useful improvements in closure caps having tamper-evident bands, and more particularly to such closure caps where rupture of such tamper-evident bands will result in the tamper-evident band dropping away from the closure cap skirt to clearly indicate that the closure cap has been at least partially removed.

Tamper-evident closure caps are commonly provided with a lower tamper-evident band which is secured to a lower free edge of a closure cap skirt by a plurality of circumferentially spaced rupturable bridges. However, even when all of such bridges break, the tamper-evident band may remain in position on a container neck finish and not positively indicate tampering once the closure cap is returned to its original position.

In accordance with this invention, it is proposed to add to the tamper-evident cap a lock ring which will lock with the bridges above the tamper-evident band, and once the bridges have ruptured, the lock ring will cause the tamper-evident band to drop down on the container neck finish and thereby give clear evidence of tampering.

In order to properly mount the lock ring the bridges should flare outwardly and downwardly so that the tamper-evident band is of a larger diameter than the closure cap skirt so as to clear both the thread of the container neck finish and the usual transfer bead behind which the tamper-evident band usually locks. This will permit the tamper-evident band to freely drop when the bridges rupture.

On the other hand, the lock ring must be of a size to both engage beneath the container transfer bead and to seat on the tamper-evidencing band. In addition, the lock ring should be of a yielding construction so as to open up and freely move down over both the container neck finish threads and the transfer bead when the closure cap is being applied.

The lock ring should also have outer peripheral notches for receiving the bridges and effect a locking of the lock ring with the bridges so as to prevent removal of the lock ring.

If necessary, the lock ring may be provided on the underside thereof with a set of depending fins for engaging the inner surface of the tamper-evident band to prevent spreading of the lock ring and thus prevent passage upwardly over the transfer bead.

With the above and other objects in view that will hereinafter appear, the nature of the invention will be more clearly understood by reference to the following detailed description, the appended claims, and the several views illustrated in the accompanying drawings.

Figure 1:
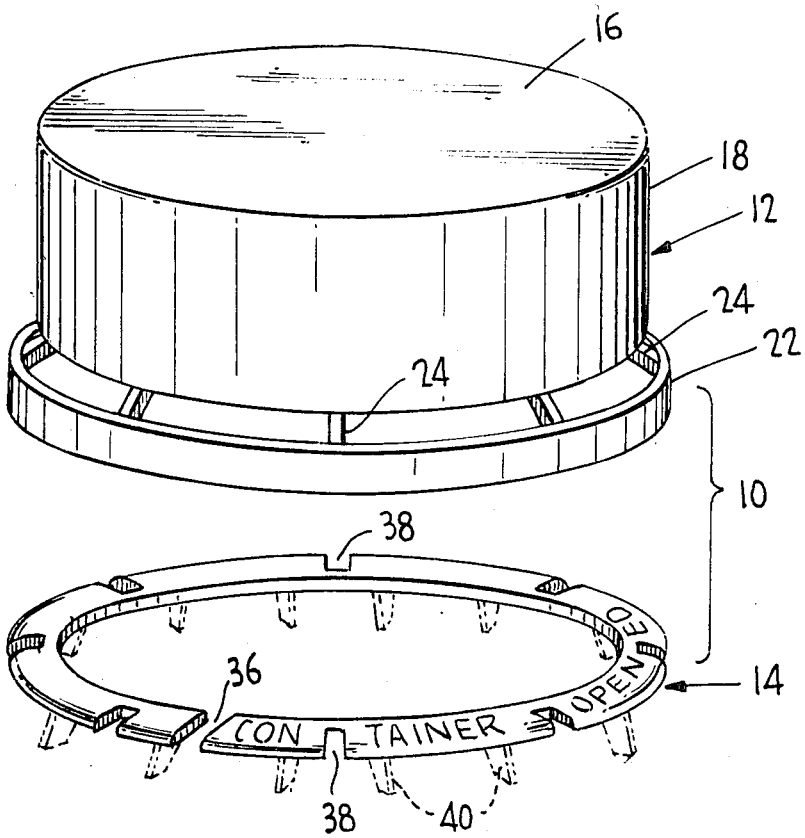
FIG. 1 is an exploded top perspective view showing the lock ring separate from the the closure cap and the tamper-evident band thereof.

Referring now to the drawing in detail, it will be seen that there is illustrated in FIG. 1 the two components which form the closure cap assembly which is the subject of this invention and is identified by the reference numeral 10. The two components of the closure cap assembly include the closure cap, generally identified by the reference numeral 12, and the lock ring, generally identified by the numeral 14.

Figure 2:
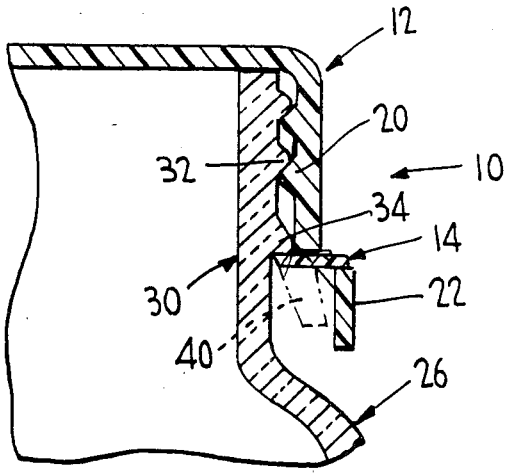
FIG. 2 is a fragmentary vertical sectional view taken through a container neck finish with the closure cap, having the lock ring installed therein, applied to the neck finish.

The closure cap is generally of a conventional construction and includes an end panel 16 having integrally molded therewith a depending skirt 18. As is best shown in FIG. 2, the skirt 18 has on the interior thereof suitable screw thread means 20 or other means for securing the closure cap to a container.

The closure cap also include a tamper-evident band 22 which is removably secured to the skirt 18 in depending relation by a plurality of circumferentially spaced rupturable bridges 24. It is to be noted that the tamper-evident band 22 differs from conventional tamper-evident bands in that it is of a diameter greater than that of the skirt. Accordingly, the bridges 24 flare outwardly and downwardly.

Referring once again to FIG. 2, it will be seen that there is illustrated the details of the neck finish 30 of a container 26 which is carried by a shoulder 28 of the container. The neck finish 30 is of a conventional construction and includes external screw thread mean 32 with which the screw threads of the closure cap mesh.

The neck finish 30 also includes the usual transfer bead 34 beneath which the temper-evident band usually engages. However, it will be seen that the tamper-evident band 22 is of an internal diameter to freely pass over both the thread means 32 and the transfer bead 34.

Referring now to the lock ring 14, it will be seen that it is in the form of a flat ring having a radial split as at 36 to freely expand over the thread means 32 and the transfer bead 34 when the closure cap 12 is being applied.

The lock ring 14 will have an internal diameter less than that of the transfer bead 34 so as to seat under the transfer bead when the closure cap is applied. It will also have an external diameter to seat on the tamper-evident band 22.

In order to both clear the bridges and to lock with the bridges, the lock ring is provided with a series of notches 38 in the external periphery of the lock ring. The notches 38 are circumferentially spaced in accordance with the spacing of the bridges 24 so as to receive the bridges.

After the lock ring 14 is assembled with the closure cap, it will remain in place during the application of the closure cap 12. Further after the closure cap is applied, the interlock will be one such that it cannot be manually removed.

Figure 3:
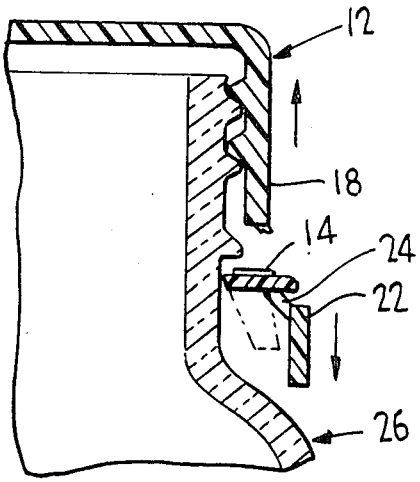
FIG. 3 is another fragmentary vertical sectional view similar to FIG. 2 with the closure cap being partially removed and the tamper-evident band and lock ring having dropped down.

Referring now to FIG. 3, it will be seen that as the closure cap 12 is being removed from the container 26, it moves up on the neck finish 30. However, the lock ring 14 remains locked under the transfer bead 34 and does not move up with the closure cap 12. The outer periphery of the lock ring 14 overlies the tamper-evident band 22, thereby preventing the tamper-evident band from moving up on the neck finish 30 and tensioning the bridges 24 until the bridges 24 break or rupture.

The tamper-evident band 22 and the lock ring 14 are now free to drop relative to the transfer bead 34 to positively indicate that the closure cap 12 has at least partially been removed.

The resiliency of the lock ring 14 should be one where when the lock ring expands radially outwardly to clear the thread means 32 and the transfer bead 34, it will return to its original size for locking under the transfer bead. However, should it become necessary, the lock ring may be provided with a set of depending fins 40 on its underside. The fins 40 will be positioned to engage within the tamper-evident band 22 which will force the lock ring 14 under the transfer bead 34 to effect a positive operation of the lock ring 14.

When the lock ring is molded in a color contrasting to that of the closure cap, the lock ring can signal tampering in an obvious way as it becomes fully visible. Lettering molded into the top of the lock ring would also increase the message. Such lettering would be hidden by the skirt 18 until opening or tampering occurs.

Although only a perferred embodiment of the tamper-evident means, including the lock ring has been specifically illustrated and described, it is to be understood that minor variations may be made without departing from the spirit and scope of the invention as defined by the appended claims.

I claim:

1. A closure cap comprising a body including an end wall and a depending skirt, and tamper-evident means carried by said skirt, said tamper-evident means being in the form of a tamper-evident band releasably connected to said skirt by a plurality of circumferentially spaced rupturable bridges, said tamper-evident band having a minimum internal diameter greater than the internal diameter of said skirt with the internal diameter of said tamper-evident band being one which will clear a customary container neck finish transfer bead behind which a tamper-evident band customarily engages.

2. A closure cap according to claim 1 wherein said bridges slope radially outwardly and downwardly from said skirt.

3. A closure cap according to claim 1 wherein a lock ring is positioned between said skirt and said tamper-evident band for engagement behind a closure neck finish transfer bead to tension and rupture said bridges when said closure cap is initially removed from a container neck finish.

4. A closure cap according to claim 3 wherein said lock ring is radially expansible to clear threads and a transfer bead of an associated container neck finish during the application of said closure cap.

5. A closure cap according to claim 4 wherein said lock ring is in the form of a radially split flat ring.

6. A closure cap according to claim 3 wherein said lock ring is of a radial width to overlie said tamper-evident band and apply pressure to said tamper-evident band from a container neck finish transfer bead.

7. A closure cap according to claim 6 wherein said lock ring has a plurality of radial notches in an outer periphery thereof, said notches being spaced in accordance with the spacing of said bridges and having received therein said bridges to lock said lock ring to said closure cap.

8. A closure cap according to claim 3 wherein said lock ring has depending from an underside thereof a set of depending fins for engaging said tamper-evident band and limiting radially outward expansion of said lock ring.

9. A combination of a lock ring and a closure cap having a tamper-evident band connected to a skirt of said closure cap by a plurality of depending ruptureable bridges, said lock ring being radially outwardly expansible and of an external diameter to sit on said tamper-evident band.

10. A lock ring according to claim 9 wherein said lock ring is of a flat construction and is radially split.

11. A lock ring according to claim 10 wherein said lock ring has a plurality of bridges receiving notches in the outer periphery thereof.

12. A lock ring according to claim 10 wherein said lock ring has a set of depending fins for engaging an interior surface of an associated tamper-evident band to limit radial expansion of said lock ring.

13. A lock ring for use with a closure cap having a tamper-evident band connected to a skirt of said closure cap by a plurality of depending ruptureable bridges, said lock ring being radially outwardly expansible and of an external diameter to sit on a corresponding tamper-evident band, said lock ring being of a flat construction and being radially split, said lock ring having a plurality of bridges receiving notches in the outer periphery thereof.

14. A lock ring for use with a closure cap having a tamper-evident band connected to a skirt of said closure cap by a plurality of depending ruptureable bridges, said lock ring being radially outwardly expansible and of an external diameter to sit on a corresponding tamper-evident band, said lock ring being of a flat construction and being radially split, said lock ring having a set of depending fins for engaging an interior surface of an associated tamper-evident band to limit radial expansion of said lock ring.

* * * * *